United States Patent [19]

Anzai

[11] 4,122,919

[45] Oct. 31, 1978

[54] SPEED CONTROL APPARATUS FOR AC ELEVATOR

[75] Inventor: Nobuo Anzai, Inazawa, Japan

[73] Assignee: Mitsubishi Denki Kabushiki Kaisha, Tokyo, Japan

[21] Appl. No.: 778,218

[22] Filed: Mar. 16, 1977

[30] Foreign Application Priority Data

Mar. 23, 1976 [JP] Japan ..... 51-31579
Apr. 13, 1976 [JP] Japan ..... 51-41711

[51] Int. Cl.[2] ..... B66B 1/30
[52] U.S. Cl. ..... 187/29 R; 318/408
[58] Field of Search ..... 187/29; 318/408

[56] References Cited

U.S. PATENT DOCUMENTS

| | | | |
|---|---|---|---|
| 2,393,998 | 2/1946 | Mahnke | 318/408 X |
| 2,974,267 | 3/1961 | Holcombe | 318/408 X |
| 3,687,235 | 8/1972 | Mitsui et al. | 187/29 |
| 3,798,519 | 3/1974 | Habisohn | 187/29 X |
| 4,042,069 | 8/1977 | Ohira et al. | 187/29 |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

A speed control apparatus for AC elevator comprises a multi-speed AC motor having two or more windings and a power running circuit for starting the motor by a low speed winding in the acceleration and switching to a high speed winding after accelerating it near the synchronous speed.

1 Claim, 6 Drawing Figures

SPEED CONTROL APPARATUS FOR AC ELEVATOR

BACKGROUND OF THE INVENTION

The present invention relates to an improvement of a speed control apparatus of an AC elevator.

The speed control system for the AC elevator include the feedback control system with a DC braking torque. That is, the high speed operation is carried out by a high speed motor and the high speed motor is disconnected from the power source when reaching to the decelerating position, and a DC current is simultaneously fed to the low speed motor by a control device having thyristors, etc., whereby the low speed motor generates the braking torque to decelerate the cage. In this case, in order to attain stable landing acccuracy and excellent confort of ride, the feedback control system is usually employed so as to generate suitable braking torque by controlling the thyristor of the controlled rectifying circuit.

This system imparts excellent characteristics of the elevator, however, the kinetic energy during the braking period is lost as heat whereby the power is lost and the temperature in the machine room is raised disadvantageously.

It has been known to decelerate the cage by the regnerative braking torque after switching to the low speed motor as the other control system for the AC elevator.

In this case, an AC power source is connected to the low speed motor to impart the regenerating braking torque in the range of higher than the synchronous speed. When the cage is decelerated to the synchronous speed of the low speed motor, the motor is switched to the power running operation to continue the low speed run to the predetermined position. At the predetermined position, the AC power source is disconnected and the cage is stopped by the electromagnetic brake.

In the system, the kinetic energy of the elevator is regenerated as the power source, whereby the saving of power can be expected. However, the torque cannot be controlled after decelerating to the synchronous speed of the low speed motor. Accordingly, it is necessary to stop it by an electromagnetic brake etc. when reaching to the predetermined position, after running it at a constant low speed. The low speed running period is a lost time for the elevator (non-control section). The time required for the operation is prolonged to remarkably decrease the function of transportation.

In the other system, th cage running by a high speed motor of a multi-speed induction motor is decelerated by regenerative braking under switching it to the low speed motor and the other braking torque such as DC braking torque is actuated before reaching to the equilibrium of the torque of the low speed motor and the load torque. The kinetic energy of the elevator is regenerated as the power source and the deceleration is imparted to save the power. On the other hand, in the low speed region of incapable of the regenerative damping, the DC braking or the electromagnetic brake etc. is actuated whereby the cage is landed at the predetermined position without long constant low speed running. However, in this system, the low speed motor is actuated only in the deceleration and the saving of the power is not satisfactory.

SUMMARY OF THE INVENTION

It is an object of the present invention to provide a speed control apparatus for AC elevator which saves the power and impart excellent confort of ride and has excellent function of transportation.

The foregoing and other objects of the present invention have been attained by providing a speed control apparatus for AC elevator which comprises a multi-speed AC motor having two or more windings and a power running circuit for starting the motor by a low speed winding in the acceleration and switching to a high speed winding after accelerating it near the synchronous speed.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, wherein like reference numerals designate identical or corresponding parts throughout the several views, in which.

DETAILED DESCRIPTION OF THE PREFERRED EMBODIMENTS

Figure 1:
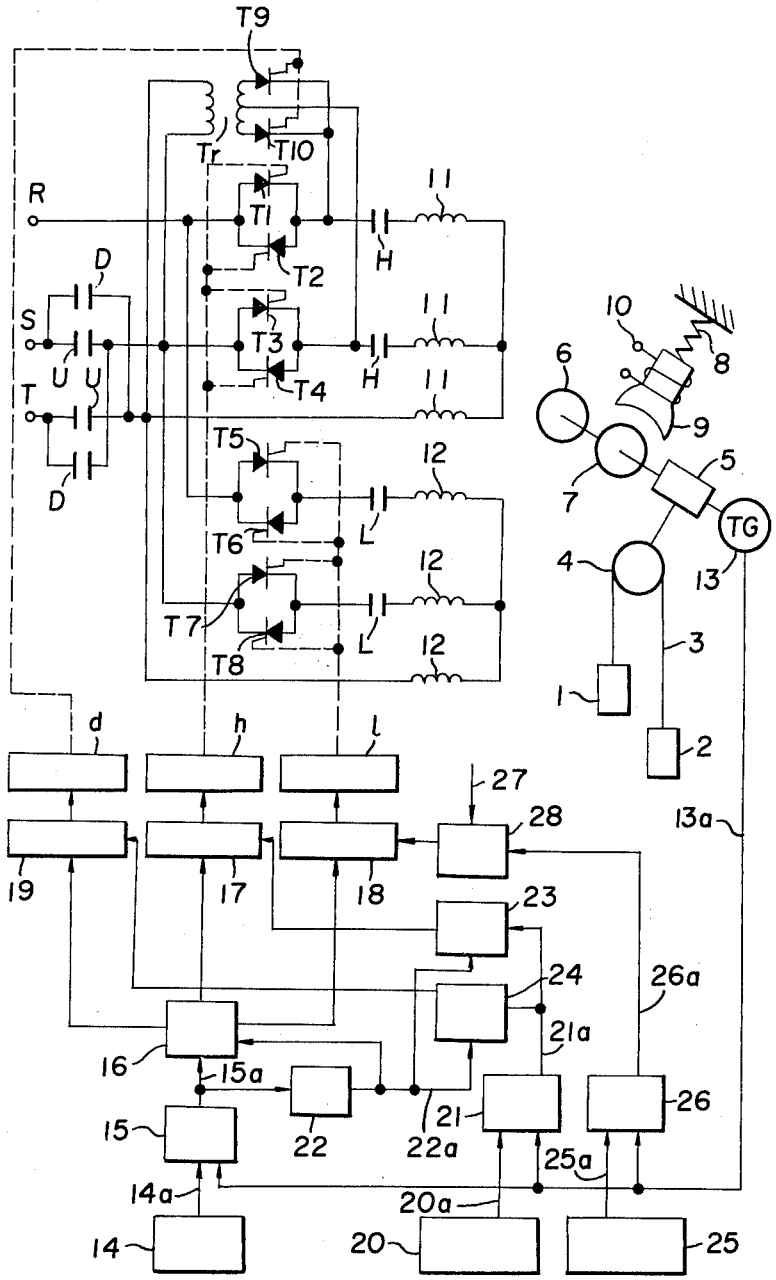
FIG. 1 is a circuit diagram of one embodiment of the speed control apparatus for AC elevator according to the present invention.

A preferred embodiment of the present invention will be described by referring to the drawings.

In FIG. 1, the reference numeral 1 designates a cage of an elevator; 2 designates a counter-weight; 3 designates a main rope for connecting the cage 1 to the counter-weight 2; 4 designates a driving sheave to which the main rope 3 is wound; 5 designates a reduced gear which is connected to the sheave by a shaft to rotate it; 6 designates a rotor of an elevator driving motor; 7 designates a brake drum which is braked by a brake shoe 9 which push the brake drum 7 by a spring 8. The brake shoe 9 is departed from the brake drum 7 by exciting the winding 10 to be the brake free. The electromagnetic brake comprises the brake drum 7, the spring 8, the shoe 9 and the winding 10. The rotor 6 is connected to the brake drum 7 on the same axial line and the cage 1 is driven or braked through the reduced gear 5 and the sheave 4. The reference numeral 11 designates a high speed winding of the elevator driving motor; 12 designates a low speed winding of the motor. Two speed motor having two windings and one rotor comprises the rotor 6 and the windings. The reference H designates a contact of a high speed contactor; L designates a contact of a low speed contactor; $T_1$ to $T_4$ designates thyristors for high speed and $T_5$ to $T_8$ designate thyristors for low speed; U designates a contact of a contactor for ascending and D designates a contact of a contactor for descending; $T_9$ and $T_{10}$ designate thyristors for braking which are connected to the secondary windings of a transformer $T_r$ for braking so as to form a center tap full wave rectifying circuit. The reference numeral 13 designates a tachometer generator which is connected to the shaft of the elevator driving motor; 14 designates a speed reference generator for the elevator; 15 designates an add amplifier for forming difference of the output 13*a* of the tachometer generator 13 from the output 14*a* of the speed refence generator 14; 16 designates a switching device and the output 15*a* of the add amplifier 15 is allotted through an operational amplifier 17 having a delay element to the firing angle control circuit *h* for phase control of thyristors $T_1$ to $T_4$; an operational amplifier 18 having a delay element for phase control of thyristors $T_5$ to $T_8$; through an operational amplifier 19 having a delay element to the firing angle control circuit *d* for phase control of thyristors $T_9$, $T_{10}$. The reference numeral 20 designates a device for generating the voltage 20*a* corresponding to the synchronous speed of the rotor 6 in the three-phase excitation of the low speed winding 12; 21 designates a slip detector to output the difference 21*a* of the voltage 20*a* from the output 13*a;* 22 designates a detector which generate the output 22*a* when the output 15*a* reached to a predetermined value;

23 designates a switching device which feeds the output 21*a* to the operational amplifier 17 so as to set the initial value of the delay element to the output 21*a* when the output 22*a* is generated; and 24 designates a switching device which feeds the output 21*a* to the operational amplifieer 19 so as to set the initial value of the delay element to the output 21*a*. The output 22*a* is also fed to the switching device 16. The reference numeral 25 designates a device for generating the voltage 25*a* corresponding to the synchronous speed of the rotor 6 in the three-phase excitation of the high speed winding 11; 26 designates a slip detector which outputs the difference 26*a* of the voltage 25*a* from the output 13*a;* 27 designates deceleration command signal which is generated depending upon a position detector in a hatchway (not shown). When the command signal 27 is generated, the output 26*a* is fed through the switching device 28 to set the initial value of the delay element of the operational amplifier 18 to the output 26*a*.

Figure 2:
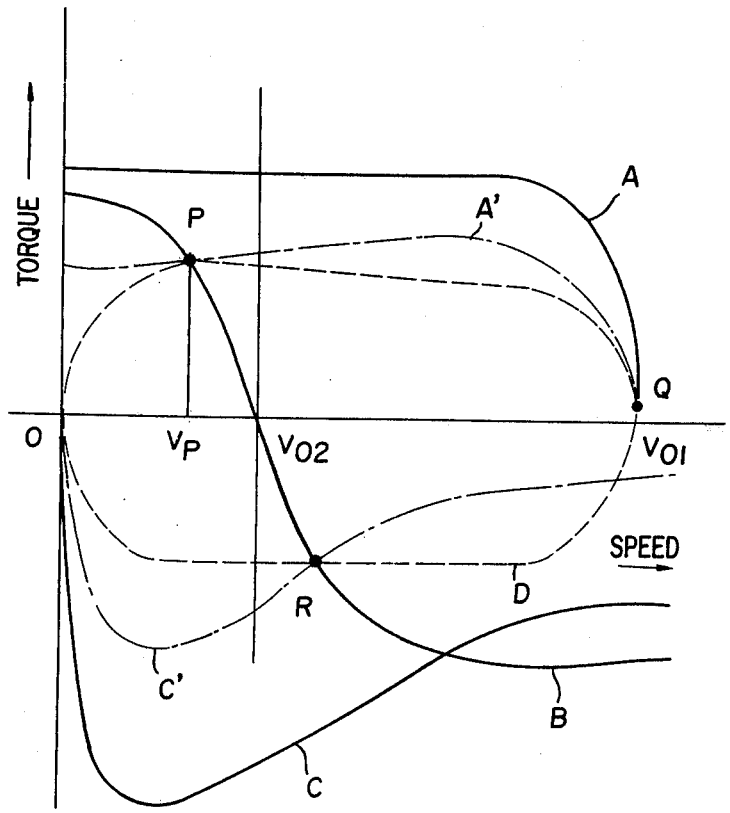
FIG. 2 is a speed-torque characteristic curve of a motor.

FIG. 2 is a speed-torque characteristic curve of the motor wherein (A) designates a torque in the excitation of the high speed winding 11 at the rated voltage; A' designates a torque under descreasing the voltage by controlling the thyristors $T_1$ to $T_4$; (B) designates a torque in the excitation of the low speed winding 12 at the rated voltage; (C) designates a DC braking torque under full firing the thyristors $T_9$, $T_{10}$; (C') designates a torque under decreasing a DC voltage applied to the high speed winding 11 by controlling the thyristors $T_9$, $T_{10}$ and the dotted line curve D is a locus of torque required from the acceleration to the braking and stop under certain load such as a full load of the elevator.

The operation of the embodiment will be illustrated.

In the ascending operation of the cage 1, the electromagnetic brake is operated to depart the brake shoe 9 from the brake drum 7 and the contacts U, L, H are closed whereby the output 15*a* is fed to the operational amplifier 18 by the switching device 16. When the speed reference generator 14 causes to gradually increase the output 14*a* whereby the firing angle control circuit l is operated and the thyristors $T_5$ to $T_8$ are gradually turned on to apply the three-phase voltage to the low speed winding 12, and the rotor 6 is rotated to accelerate the cage 1 to the ascending direction. When the rotor 6 is rotated, the tachometer generator 13 is rotated to generate the output 13*a*. The feedback control system is formed and the torque of the motor is controlled along the curve D in FIG. 2, and the cage 1 begins to smoothly be accelerated.

When the speed of the cage 1 reached near $V_p$ in FIG. 2, the torque of the low speed motor is gradually decreased whereby the output 15*a* as the speed difference is increased and the detector 22 generates the output 22*a* and the switching device 23 is actuated to set the output 21*a* into the operational amplifier 17.

The output 21*a* corresponds to the slip of the rotor 6 in the excitation of the low speed winding 12. The sensitivity of the detector 21 is adjusted as desired and the operational amplifier 17 is preset so as to result the same torque by the low speed winding 12 at the point P, by the high speed winding 11. When the output 22*a* is generated, the output 15*a* is switched from the operational amplifier 18 to the operational amplifier 17 by the switching device 16 as well as the above operation. As the result, the thyristors $T_5$ to $T_8$ are turned off and the low speed winding 12 are disconnected from the power sources (R),(S),(T). The thyristors $T_1$ to $T_4$ are simultaneously turned on and the high speed winding 11 is excited by the initial value given by the preset whereby the same torque by the low speed winding 12 is given by the high speed winding 11 and the shock is not caused at the switching and the confort of ride is not harmed. The acceleration is continued by the high speed winding 11 and then the maximum speed of the cage 1 is given to operate at the point Q in FIG. 2.

When a call is given or a stopping command is given from the car controller (not shown), a position detector is actuated to generate the output 27. The output 26*a* corresponds to the slip under driving the rotor 6 by the high speed winding 11. The sensitivity of the detector 26 is selected as desired. Accordingly, the same torque of the rotor 6 caused by the high speed winding 11 can be generated in the rotor 6 by the initial value of the delay element of the operational amplifier 18 when the excitation of the low speed winding 12 is given through the thyristors $T_5$ to $T_8$ and the firing angle control circuit l. When it reaches to the deceleration point, the output 14*a* of the speed reference generator 14 begins to decrease and the output 15*a* of the amplifier 15 is turned over, and is switched from the operational amplifier 17 to the amplifier 18 by the switching device 16. As the result, the thyristors $T_1$ to $T_4$ are turned off and the thyristors $T_5$ to $T_8$ begin to be turned on so as to generate the torque corresponding to the torque by the high speed winding 11 to the rotor 6 by the low speeed winding 12. It is braked and decelerated by the regenerative braking torque generated by the low speed winding 12 to the point R in FIG. 2. When it reaches to the point R, the thyristors $T_5$ to $T_8$ are full fired to apply full voltages to the low speed winding 12, the required torque is not generated. Thus, the detector 22 is actuated to generate the output 22*a* and the output 21*a* is preset through the switching device 21*a* to the delay element of the operational amplifier 19. The degree of the preset is selected to generate the DC braking torque by the thyristors $T_9$, $T_{10}$ as same as the torque by low speed winding 12 under adjusting the sensitivity of the detector 21. Accordingly, the shock is not caused at the switching. The output 22*a* is fed to the switching device 16 and the output 15*a* is switched from the operational amplifier 18 to the amplifier 19 by the switching device 16 and the DC braking operation is resulted by the amplifier 19 and the firing angle control circuit *d*.

The speed reference output 14*a* gradually decreased to zero according as object floor, and the cage 1 is landed under the DC braking. At the same time, the electromagnetic brake is actuated to push the shoe 9 to the brake drum 7 whereby the cage 1 is stopped and maintained. The switching device 16 simultaneously breaks the output 15*a* from the amplifier 19 whereby the thyristors $T_9$, $T_{10}$ are turned off and then the contacts U, L, H of the contactors are opened.

The full load ascending operation has been illustrated. In this case, the initial value is set to generate, by the low speed winding 12, the same torque generated by the high speed winding 11 in the amplifier 18 prior to the initiation of deceleration. However, in the full load ascending operation, the torque generated by the high speed winding 11 in the full speed running is the torque for ascending the cage 11.

On the otheer hand, the torque generated by the three-phase excitation of the low speed winding 12 is the regenerative braking torque which is negative torque. The torque generated by the high speed winding 11 can not be generated by the low speed winding 12. In this case, the condition of the excitation of the low speed winding 12 for minimizing the shock caused by switching from the high speed to the low speed, is zero of the initial value which corresponds to the condition that the low speed winding 12 does not generate any torque by switching from the high speed to the low speed.

In the full descending operation, the effect of the present in the switching can be further understood.

It this case, the high speed winding 11 generates the regenerative braking torque required for descending at a constant speed under holding the full load in the full speed running operation.

The amplifier 18 is preset so as to generate the regenerative braking torque being the same with said torque, whereby the switching operation can be attained without any shock.

Figure 3:
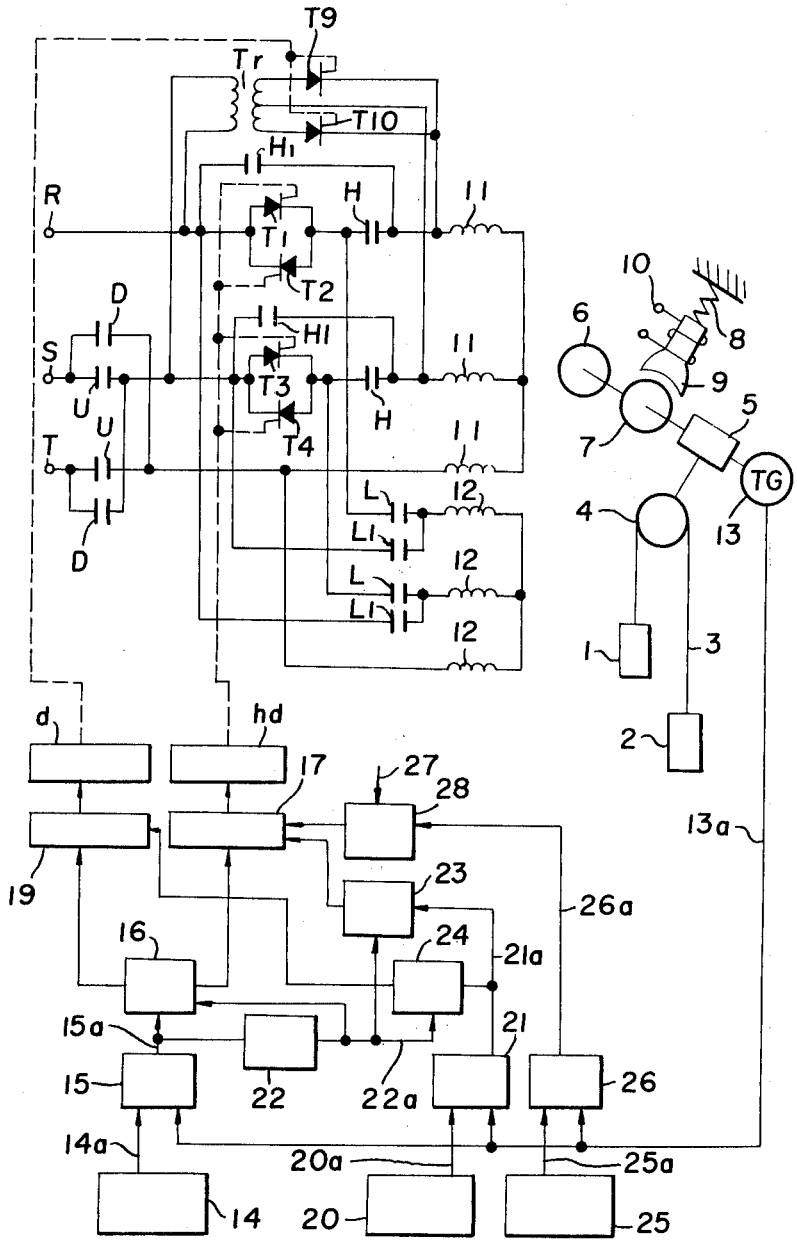
FIGS. 3, 4 and 5 are respectively circuit diagrams of the other embodiments of the speed control apparatus for AC elevator according to the present invention.

FIG. 3 shows the other embodiment of the present invention.

The operation of th embodiment in FIG. 3 is substantially the same with that of FIG. 1.

In FIG. 3, thyristors $T_1$ to $T_4$ and $T_5$ to $T_8$ are commonly used. The amplifiers (17) and (18) are also commonly used as the amplifier 17. The firing angle control circuits *h* and l are also commonly used as the circuit (hl). The reference ($H_1$) designates a contact of a contact or for connecting the power-sources R, S to the high speed winding 11 in the short-circuit when all of the thyristors ($T_1$) to ($T_4$) are full fired. The reference ($L_1$) designates a contact of a contactor for connecting the power sources (R), (S) to the low speed winding 12 in the short-circuit when all of the thyristors ($T_1$) to ($T_4$) are full fired.

In the full load ascending operation, the electromagnetic brake is opened and the speed reference generator 14 is actuated by closing the contacts (U), (L) to actuate the amplifier 17 through the amplifier 15 and the switching device 16 and the firing angel control circuit (hl) is actuated to gradually turn on the thyristors ($T_1$) to ($T_4$), and the threephase voltage is applied to the low speed winding 12 whereby the cage 1 is started.

When the cage 1 reaches to the point corresponding to the point P in FIG. 2, the accelerating torque is further lower than the required torque even though the thyristors ($T_1$) to ($T_4$) are full fired. Accordingly, the deviation signal output 15*a* is increased to actuate the detector 22 and the contact ($L_1$) is closed by the output whereas the contact (L) is opened. At the same time, the initial value of the amplifier 17 is set to the output 21*a* through the switching device 23, and then, the contact (H) is closed and the contact ($L_1$) is simultaneously opened.

Thus, the three-phase excitation is given through the thyristors ($T_1$) to ($T_4$) and the contact (H) to the high speed winding 11 until reaching to the full speed. When it reaches to the full speed, the contact ($H_1$) is closed and the contact (H) is opened and the thyristors ($T_1$) to ($T_4$) are turned off, and all currents pass through the contact ($H_1$).

In the decelerating operation, the initial value of the amplifier 17 is fed by the switching device 28 to the output 26*a* at the initiation of deceleration so as to generate, by the low speed winding 12, the torque corresponding to the torque generated by the high speed winding 11. The contact (L) is closed again and the contact ($H_1$) is opened so as to decelerate the cage by the regenerative braking torque until reaching to the point (R) in FIG. 2.

At the point (R) in FIG. 2, the regenerative braking torque is lower than the required torque (D). Accordingly, the speed deviation signal output 15*a* is increased to actuate the detector 22 and the output 22*a* is generated to preset the output 21*a* of the detector 21 to the amplifier (19) through the switching device 24. The switching device 16 breaks the output 15*a* from the amplifier 17 to fed the output to the amplifier 19. Accordingly, the thyristors ($T_1$) to ($T_4$) are turned off and the thyristors ($T_9$), ($T_{10}$) are turned on and the contact ($L_1$) is opened by the command of the detector 22.

Thus, the cage 1 is decelerated to land by the braking as the same with the operation of the embodiment of FIG. 1.

The circuit of FIG. 3 can be economical because parts of the amplifiers, the firing angle control circuits and the main thyristors are respectively commonly used.

Figure 4:
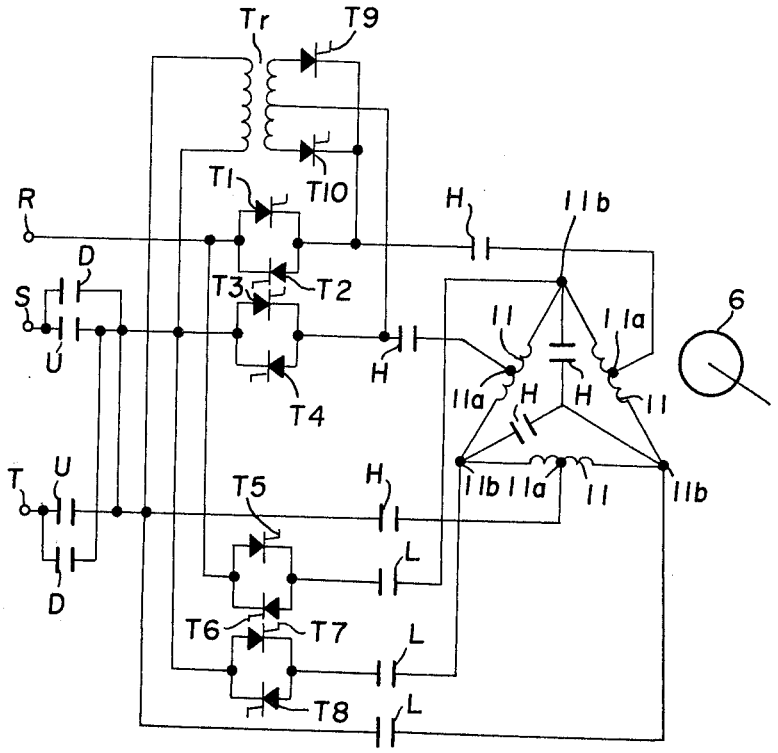

FIG. 4 shows only the main circuit and the rotor 6 of the other embodiment of the present invention.

In FIG. 4, the reference numeral 11 designates a primary winding of a pole change motor. When the three-phase voltage is applied to the middle tap 11*a* the terminal 11*b* are closed, the high speed is given. When the three-phase voltage is applied to the terminal 11*b* and the terminals 11*a* are opened, the low speed of about ½ to the high speed is given. The other structure is the same with that of FIG. 1.

When the low speed winding is used at the initiation of acceleration and the regenerative braking is used at the initiation of deceleration, the loss of the motor having a pole ratio of 2:1 is minimum. Accordingly, the circuit is optimum to minimize heating is two step speed. In general, the pole change motor is economical in comparison with the two step speed motor having double windings and accordingly, it is economical in the structure.

Incidently, similar result can be attained by using the terminal voltage signal of the low speed winding 12 instead of the deviation signal 15*a* for the condition breaking the low speed windings 12. In this case, the terminal voltage corresponds to the deviation signal 15*a*.

As described above, in accordance with the invention, the low speed winding is used in the acceleration to accelerate the cage near the synchronous speed and then it is changed to the high speed winding whereby the power consumption of the motor can be remarkably decreased.

The value corresponding to the slip of the motor is detected and the initial value of the firing angle of the thyristors is set so as to be equal the torque by the high speed winding to the torque by the low speed winding in the switching from the low speed winding to the high speed winding. Accordingly, the switching can be smoothly accomplished without harm of confort of ride.

Figure 5:
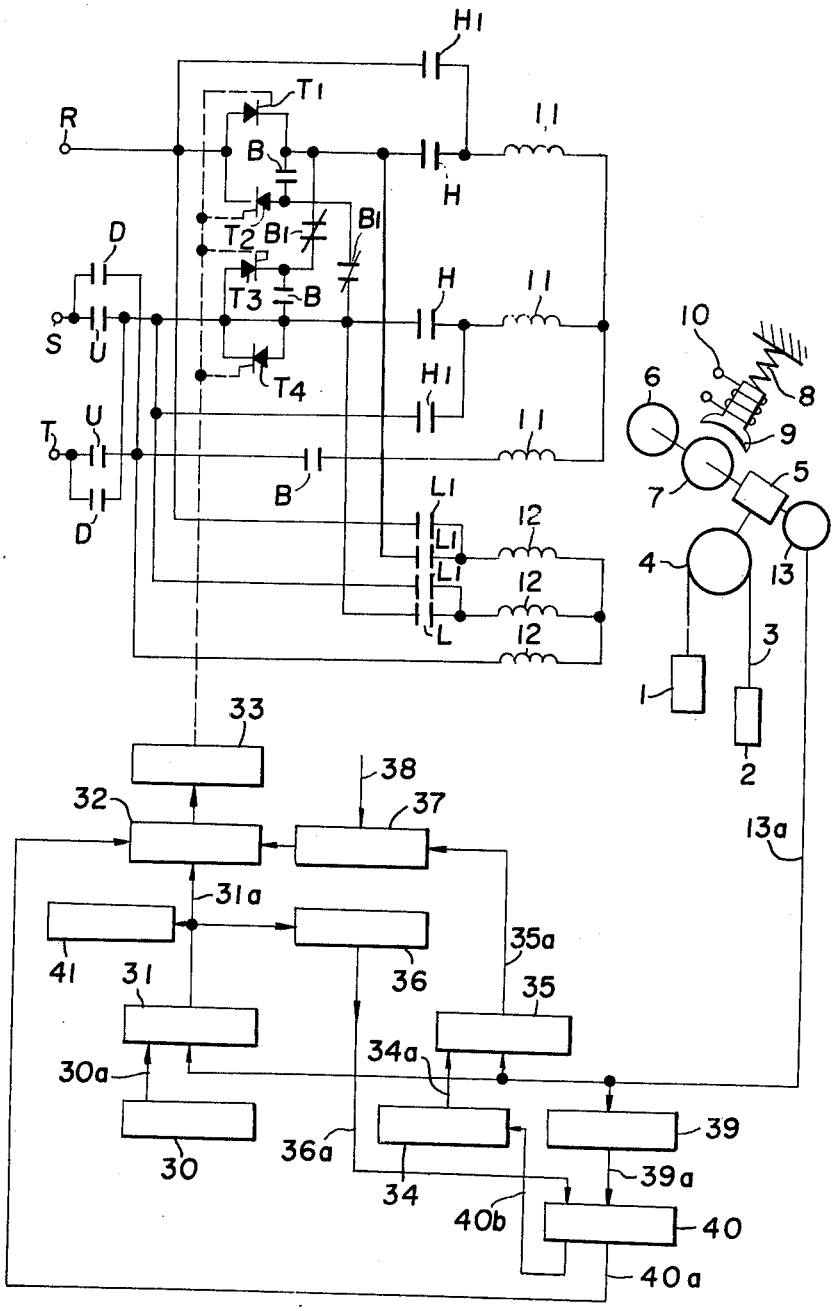

FIG. 5 shows the other embodiment of the apparatus of the invention wherein the references 1 to 12 designate the same with those of FIG. 1.

The reference (H) designates a contact of the high speed contactor; (L) designates a contact of the low speed contactor; ($T_1$) to ($T_4$) designate thyristors for controlling the high speed winding 11 and the low speed winding 12; ($H_1$) designates a contact of the contactor connecting the high speed winding 11 to the power sources (R), (S) with the side passage of the thyristors ($T_1$) to ($T_4$); ($L_1$) designates a contact of the contactor connecting the low speed winding (12) to the power sources (R), (S) with the side passage of the thyristors ($T_1$) to ($T_4$); (B), ($B_1$) respectively designate contacts of the contactor for switching the thyristors ($T_1$) to ($T_4$) from the power running to the DC braking. When the contact (B) is closed and the contact ($B_1$) is opened, the thyristors ($T_1$), ($T_2$) are connected in inverse parallel in R phase, and the thyristors ($T_3$), ($T_4$) are connected in inverse parallel in S phase, to form a power running control circuit.

When the contact (B) is opened and the contact ($B_1$) is closed, the thyristors ($T_1$), ($T_4$) are turned on in positive half wave of the power source R to the power source S and the thyristors ($T_2$), ($T_3$) are turned on in negative half wave of the power source R to the power source S, to form a single phase full wave DC braking circuit.

The reference (U) designates a contact of a contactor for ascending and (D) designates a contact of a contactor for descending; 30 designates a speed reference generator for generating the speed reference value 30*a* for determing the speed of the cage; 13 designates a tachometer generator for generating the speed signal 13*a;* 31 designates an operational amplifier to output the difference 31*a* of the speed signal 13*a* from the speed reference signal 30*a;* 32 designates an operational amplifier having a delay element; 33 designates a firing angle control circuit for phase-control of the thyristors ($T_1$) to ($T_4$); (34) designates a constant-voltage device for generating the speed reference value 34*a* corresponding to the synchronous speed by the high speed winding 11; 35 designates an operational amplifier for generating the differential signal 35*a* between the speed signal 13*a* and the reference value 34*a;* 36 designates a deviation detector for generating the output 36*a* by detecting the time reaching the differential signal 31*a* to a predetermined value; 37 designates a switching device for setting the differential signal 35*a* as the initial value of the delay element of the operational amplifier 32 when generating the accelerating or decelerating command 38; 39 designates a speed detector for generating low speed breaking signal 39*a* when reaching the speed signal 13*a* to the value corresponding to the synchronous speed by the low speed winding; and 40 designates a control circuit for actuating the coil (not shown) of the contactor to operate the contacts (L), ($L_1$), (H) ($H_1$), (B), ($B_1$) as described below, and to feed the output 40*a* the amplifier 32 and to feed the output 40*b* to the constant-voltage device 18 so as to change the voltage set point. The reference numeral 41 designates a switching detector which amplifies the speed deviation signal 31*a* in the below mentioned partial speed operation to close the contact (L) or ($L_1$) of the contactor in the positive polarity and to close the contact (B) of the contactor in the negative polarity.

Figure 6:
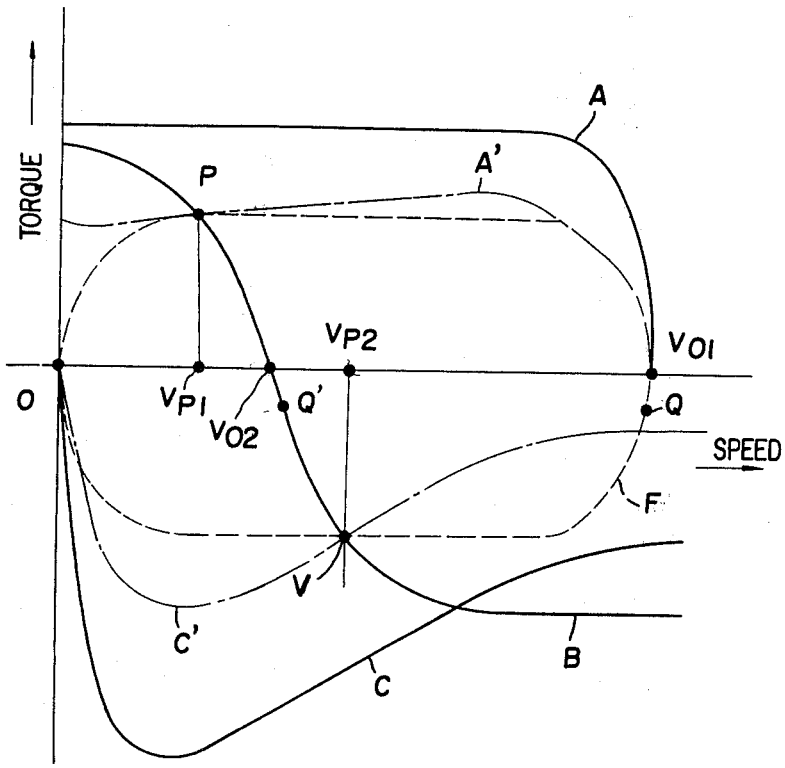
FIG. 6 is a speed-torque characteristic curve of a motor.

FIG. 6 is a speed-torque characteristic curve wherein the speed of the cage i.e. the rotor revolution speed is given in abscissas and the torque of the rotor is given in ordinates. The reference (A) designates a torque in the excitation of the high speed winding (11) at the rated voltage; (A′) designates a torque under decreasing the voltage by controlling the thyristors ($T_1$) to ($T_4$); (B) designates a torque in the excitation of the low speed winding 12 at the rated voltage; (C) designates a torque in the DC braking of the high speed winding 11 by full firing of the thyristors ($T_1$) to ($T_4$); (C′) designates a torque in the DC braking by controlling of firing angles of the thyristors ($T_1$), ($T_4$); and (F) designates a locus of torque required from the acceleration to the braking and stopping under certain load such as the full load descending operation.

The operation of the embodiment will be illustrated.

In the descending operation of the cage 1, the electromagnetic brake is operated to depart the brake shoe 9 from the brake drum 7 and the contacts (D), (L), (B) of the contactors are closed and the contacts (U), ($L_1$), (H), ($B_1$) of the contactors are opened. The output 30*a* is gradually increased by the speed reference generator 30 and is fed through the amplifiers 31 and 32 to the firing angle control circuit 33. The circuit operates to gradually turn on the thyristors ($T_1$) to ($T_4$) whereby the torque is gradually generated in the low speed winding 12 to begin the acceleration of the cage 1. When the cage 1 is accelerated to reach the speed to $V_{P1}$ in FIG. 6, the low speed winding 12 cannot generate the required torque (F) required for accelerating along the speed curve indicated by the speed reference value 30*a*. Accordingly, in the firing angle control circuit 33, the full firing signal is fed to the thyristors ($T_1$) to ($T_4$) and the differential signal 31*a* is increased and the deviation detector 36 is operated to generate the output 36*a* whereby the control circuit 40 is operated to close the contact ($L_1$) of the contactor to by-pass the thyristors ($T_1$) to ($T_4$). At the same time, the output 40*a* is fed to the amplifier 32 to give zero of the initial value of the delay element thereof and the thyristors ($T_1$) to ($T_4$) are turned off. When the current passed through the thyristors ($T_1$) to ($T_4$) becomes zero, the contact (L) of the contactor is opened and then, the contact (H) of the contactor is closed. When the output 40*a* is not fed to the amplifier 32, the delay element of the amplifier 32 is charged by the deviation signal 31*a* and the thyristors ($T_1$) to ($T_4$) are gradually turned on and the voltage of the high speed winding (11) is gradually increased by feeding through the contact (H) of the contactor so as to accelerate the cage to reach the speed $V_{O2}$ in FIG. 6. The speed $V_{O2}$ is the synchronous speed of the low speed winding 12. Accordingly, the speed detector 39 is operated to generate the low speed breaking command 39*a* to feed it to the control circuit 40 whereby the contact ($L_1$) of the contactor is opened to break the low speed winding 12. The current passed through the low speed winding 12 is small at the time whereby the wear of the contact ($L_1$) of the contactor is small. Moreover, the torque is not generated as shown in FIG. 6, the breaking does not cause sudden change of torque whereby the confort of ride is not harmed.

The thyristors ($T_1$) to ($T_4$) are controlled by the speed detector 14, the amplifiers 31, 32 and the firing angle control 33 whereby the feedback control is attained along the speed reference value 30a to accelerate the cage 1. Then, the thyristors ($T_1$) to ($T_4$) are full fired to run the cage 1 at the normal speed. The contact ($H_1$) of the contactor is closed after a predetermined time from the initiation of acceleration. At the same time, the output 40a is generated from the control circuit 40 to give zero of the output of the amplifier 32 whereby the input of the firing angle control circuit 33 become zero and the thyristors ($T_1$) to ($T_4$) are turned off. When the current passed through the contact (H) of the contactor is zero, the contact (H) of the contactor is opened and the thyristors ($T_1$) to ($T_4$) are disconnected from the high speed winding 11 and the contact (L) of the contactor is simultaneously closed.

Thus, the decelerating command 38 is generated by the operation of the position detecting switch at the hatchway of the elevator and the control circuit (not shown).

The output 35a of the amplifier 35 corresponded to the slip of the rotor 6 and the rotating field generated by the high speed winding 11 because the output 34a of the constant voltage device 34 corresponds to the high speed by the output 40b of the control circuit 40. Accordingly, the output 35a corresponds to the torque generated by the high speed winding 11.

The output 35a is fed through the switching device 37 and is set as the initial value of the delay element of the operational amplifier 32. The low speed winding 12 generates the torque corresponding to the output through the thyristors ($T_1$) to ($T_4$) and the contact (L) of the contactor. At the same time, the contact ($H_1$) of the contactor is opened to break the high speed winding 11. Thus, the low speed winding 12 generates the regenerative braking torque show in FIG. 6(Q). Then, the deceleration is resulted by the regenerative braking torque by the low speed winding 12 to the V point in FIG. 6. At the point V, the regenerative braking torque is smaller than the required torque (F), and accordingly the thyristors ($T_1$) to ($T_4$) are fully fired and the deviation detector 36 is operated and the output is fed to the control circuit 40 to close the contact ($L_1$) to open the contact (L) of the contactor and to close the contact (H) of the high speed contactor.

The contact (B) of the contactors are opened and the contact ($B_1$) is closed and the full voltage excitation is given through the contact ($L_1$) of the contactor to the low speed winding 12 and the thyristors ($T_1$) to ($T_4$) are rearranged to be the DC control circuit.

At the same time, the initial value of the delay element of the amplifier 32 is set to be zero by the output 40a and the torque at the DC braking generated by the high speed winding 11 increases from zero and the further deceleration of the cage is attained. When the speed reaches to the value $V_{O2}$, the speed detector 39 is operated as the same with that of the acceleration so as to generate the low speed breaking command (39a) whereby the contact ($L_1$) of the contactor is opened. The low speed winding 12 is disconnected without a torque difference when it runs synchronous speed and the current is small.

Thus, the cage 1 is decelerated and landed by the DC braking along decreasing the speed reference value 30a by the tachometer generator 13, the amplifiers 31, 32, the firing angle control circuit 33, the thyristors ($T_1$) to ($T_4$), the high speed winding 11 and the rotor 6. The brake coil 10 is extinguished and the brake shoe 9 is pushed to the brake drum 7 to stop the cage 1. At the same time, the thyristors ($T_1$) to ($T_4$) are turned off to open the contact (H) of the contactor.

The full speed operation has been illustrated. Thus, the partial speed operation will be illustrated.

In the full load descending operation, the brake shoe 9 is departed to the brake drum 7, and the contacts (D), (B),(L) are closed and the speed reference value 30a of the speed reference generator 30 is gradually generated whereby the amplifiers 31 and 32 and the firing angle control circuit 33 is operated to turn on the thyristors ($T_1$) to ($T_4$). The low speed winding 12 is gradually excited to begin the acceleration of the cage (1) along the speed reference value 30a.

Even though the speed of the cage (1) reached to the value $V_{P1}$ in FIG. 6, and the output 36a is generated, the switching to the high speed winding 11 is not caused and the acceleration of the cage 1 is continued by the low speed winding 12, to reach to the point Q' in FIG. 6. The cage is run at the normal speed by the low speed winding 12. The contact ($L_1$) of the contactor is closed certain time after the initiation of the acceleration and then the contact (L) of the contactor is opened.

When the decelerating command 38 is generated, the contacts ($L_1$), (B) of the contactors are opened, and the output 35a of the amplifier 35 is set as the initial value of the delay element of the amplifier 32. At this moment, the output 34a of the constant-voltage device 34 is set to the synchronous speed by the low speed winding 12 by the output 40a of the control device 40. Accordingly, the output 35a of the amplifier 35 corresponds to the slip by the low speed winding 12, whereby the torque by the low speed winding 12 can be generated by the high speed winding 11 under setting the amplifier 35 and the amplifier of the switching device 37 to be desired. The switching of the torque can be smoothly carried out.

Thus, the cage 1 is controlled by the DC braking by the high speed winding 11 under the feedback control through the tachometer generator 13, the amplifiers 31, 32, the firing angle control circuit 33, the thyristors ($T_1$) to ($T_4$), the high speed winding 11 and the rotor 6, and is decelerated and landed along the speed reference value 30a. The coil 10 of the brake is extinguished and the mechanical-electromagnetic brake is actuated to stop it as that of the high speed operation.

In the partial speed operation, only the low speed winding 12 is excited. In the constant speed running period for the partial speed operation, the regenerative braking is resulted in the case of the descending load (e.g. full load descent) and the slip is small and the heating of the rotor is small in comparison with the voltage braking by the high speed winding, in the case of the ascending load (e.g. full load ascent).

As described above, in accordance with the present invention, the high speed winding is excited after starting by a low speed motor in the acceleration, and then the low speed motor is disconnected. In the deceleration, the regenerative braking operation by the low speed motor is switched to the DC braking by the high speed winding and then, the low speed motor is disconnected at the synchronous speed by the low speed winding. Accordingly, it is possible to obtain the AC elevator having excellent effect of saving power, and excellent confort of the ride.

The thyristors for control are commonly used for the low speed winding and the high speed winding and are used for the power running and the braking under switching them, to be ecomonical.

What is claimed is:

1. A speed control apparatus for an A.C. powered elevator, which comprises:

a multi-speed A.C. motor having a low speed winding and a high speed winding;

thyristor means for applying power to the low speed winding and the high speed winding;

switching means for connecting said thyristor means to either the low speed winding or the high speed winding;

a power running circuit for starting the motor by the low speed winding during acceleration, disconnecting the low speed winding upon reaching the synchronous speed of the low speed winding and then connecting the high speed winding, said power running circuit coupled to said switching means;

a decelerating circuit coupled to said switching means for disconnecting the high speed winding and connecting the low speed winding during deceleration, and for disconnecting the low speed winding upon reaching the synchronous speed of the low speed winding, and then connecting the high speed winding for D.C. braking thereof;

detector means for detecting the slip of said motor and setting an initial value for the firing angle of the thyristor means in accordance with the detected slip when disconnecting and connecting the low speed and the high speed windings, such that the motor produces a continuous torque upon changeover from the low speed and the high speed windings.

* * * * *